US009450311B2

(12) United States Patent
Ng et al.

(10) Patent No.: US 9,450,311 B2
(45) Date of Patent: Sep. 20, 2016

(54) POLARIZATION DEPENDENT ELECTROMAGNETIC BANDGAP ANTENNA AND RELATED METHODS

(71) Applicant: Raytheon Company, Waltham, MA (US)

(72) Inventors: Jackson Ng, Tucson, AZ (US); Charles G. Gilbert, Tucson, AZ (US)

(73) Assignee: Raytheon Company, Waltham, MA (US)

( * ) Notice: Subject to any disclaimer, the term of this patent is extended or adjusted under 35 U.S.C. 154(b) by 378 days.

(21) Appl. No.: 13/949,505

(22) Filed: Jul. 24, 2013

(65) Prior Publication Data

US 2015/0029062 A1 Jan. 29, 2015

(51) Int. Cl.

| | |
|---|---|
| ***H01Q 1/38*** | (2006.01) |
| ***H01Q 15/24*** | (2006.01) |
| ***H01Q 1/27*** | (2006.01) |
| ***H01Q 1/28*** | (2006.01) |
| ***H01Q 1/48*** | (2006.01) |
| ***H01Q 9/30*** | (2006.01) |
| ***H01Q 15/00*** | (2006.01) |

(52) U.S. Cl.

CPC ..... *H01Q 15/24* (2013.01); *H01Q 1/27* (2013.01); *H01Q 1/286* (2013.01); *H01Q 1/48* (2013.01); *H01Q 9/30* (2013.01); *H01Q 15/008* (2013.01)

(58) Field of Classification Search

CPC ..... H01Q 1/38; H01Q 9/16; H01Q 15/02
USPC ..... 343/700 MS, 729, 795, 909
See application file for complete search history.

(56) References Cited

U.S. PATENT DOCUMENTS

| | | | | |
|---|---|---|---|---|
| 4,287,518 | A * | 9/1981 | Frosch | H01Q 9/065 343/700 MS |
| 5,892,485 | A * | 4/1999 | Glabe | H01Q 19/108 343/756 |
| 6,441,792 | B1 | 8/2002 | Sievenpiper et al. | |
| 6,952,184 | B2 | 10/2005 | Sievenpiper et al. | |
| 7,855,689 | B2 | 12/2010 | Fukui et al. | |

(Continued)

FOREIGN PATENT DOCUMENTS

| | | |
|---|---|---|
| WO | WO 01/69724 A1 | 9/2001 |
| WO | WO 02/103846 A1 | 12/2002 |

OTHER PUBLICATIONS

PCT Search Report of the ISA for PCT/US2014/038317 dated Aug. 8, 2014 5 pages.

(Continued)

*Primary Examiner* — Dameon E Levi
*Assistant Examiner* — Collin Dawkins
(74) *Attorney, Agent, or Firm* — Daly, Crowley, Mofford and Durkee, LLP

(57) ABSTRACT

A rotationally polarized antenna includes a radiating element that is held in a skewed orientation with respect to an underlying polarization-dependent electromagnetic band gap (PDEBG) structure. The radiating element and the PDEBG structure are both housed within a conductive cavity. The radiating element, the PDEBG structure, and the cavity are designed together to achieve an antenna having improved operational characteristics (e.g., an enhanced circular polarization bandwidth, etc.). In some embodiments, the antenna may be implemented as a flush mounted or conformal antenna on an outer surface of a supporting platform.

29 Claims, 11 Drawing Sheets

(56) References Cited

U.S. PATENT DOCUMENTS

| | | | | |
|---|---|---|---|---|
| 8,188,928 | B2 | 5/2012 | Lin et al. | |
| 2005/0068233 | A1* | 3/2005 | Tanaka | H01Q 9/42 343/700 MS |
| 2009/0002240 | A1* | 1/2009 | Sievenpiper | H01Q 15/0013 343/700 MS |

OTHER PUBLICATIONS

PCT Written Opinion of the ISA for PCT/US2014/038317 dated Aug. 8, 2014 6 pages.

Best, et al.; "Electromagnetic Band Gap (EBG) Surfaces for Antenna Applications;" MITRE Innovation Exchange; Presentation; Jan. 2008; 9 pages.

Kim, et al.; "Reflecting Characteristics of 1-D EBG Ground Plane and It's Application to a Planar Dipole Antenna;" Progress in Electromagnetics Research; vol. 1; Aug. 2011; pp. 51-66.

Office Action dated Jan. 30, 2014, U.S. Appl. No. 13/457,546, filed Apr. 27, 2012, pp. 1-20.

Office Action dated Jan. 30, 2014, U.S. Appl. No. 13/457,547, filed Apr. 27, 2012, pp. 1-22.

* cited by examiner

| ANTENNA TYPE | FREQ (GHZ) | LENGTH (IN) | WIDTH (IN) | HEIGHT (IN) | VSWR 2:1 BW | AR 6 DB | AR 3 DB | MAX ZENITH CP GAIN (DB) |
|---|---|---|---|---|---|---|---|---|
| EM COUPLED CP | 2.2 | 3 | 2.41 | 0.24 | 8.40% | 3.50% | 1.30% | 5.65 |
| | | 0.56Λ | 0.45Λ | 0.045Λ | | | | |
| EBG CP | 3.84 | 2.677 | 2.52 | 0.302 | 20.72% | 19.08% | 15.58% | 8.98 |
| | | 0.79Λ | 0.75Λ | 0.09Λ | | | | |

POLARIZATION DEPENDENT ELECTROMAGNETIC BANDGAP ANTENNA AND RELATED METHODS

BACKGROUND

To establish a communications link, many systems (e.g., telemetry systems, Aegis, many RMS products, etc.) require antennas having high bandwidth and high gain that can be mounted flush with the skin of a missile, aircraft, or other platform, and packaged in a limited volume. Circular polarized antennas may be needed to establish a communications link when the flight orientation of a platform cannot be maintained. Higher bandwidths and higher gains are often needed to satisfy ever increasing requirements for communication distance and data rate. Flush mounted antennas minimize aerodynamic effects for an underlying platform. A volume-limited antenna can reduce or minimize mass impact. There is a need for antenna designs that are capable of achieving any combination of the above-described qualities or all of these qualities.

SUMMARY

In accordance with one aspect of the concepts, systems, circuits, and techniques described herein, a rotationally polarized antenna comprises: a ground plane; a polarization dependent electromagnetic band gap (PDEBG) structure disposed above the ground plane, the PDEBG structure having a number of unit cells arranged in rows and columns; a radiating element disposed above the PDEBG structure, the radiating element having a long dimension and a short dimension; and a conductive cavity encompassing the PDEBG structure and the radiating element, the conductive cavity being open on a radiating side of the antenna; wherein the radiating element is oriented at a non-zero angle with respect to the rows and columns of the PDEBG structure.

In one embodiment, the antenna is configured for use with circularly polarized waves.

In one embodiment, the PDEBG structure, the radiating element, and the conductive cavity are configured together to achieve an enhanced operational bandwidth.

In one embodiment, the radiating element is oriented at an angle with respect to the rows and columns of the PDEBG structure that supports substantially equal horizontal and vertical electric field magnitudes for use with circularly polarized waves.

In one embodiment, the radiating element is oriented at an angle with respect to the rows and columns of the PDEBG structure that supports different horizontal and vertical electric field magnitudes for use with non-circular elliptically polarized waves.

In one embodiment, a distance between side walls of the conductive cavity and the outermost edges of the PDEBG structure is configured to produce an additional resonance in an electrical response of the antenna that enhances a bandwidth thereof.

In one embodiment, the radiating element includes one of: a patch element, a dipole element, and a monopole element.

In one embodiment, the antenna further comprises a feed coupled to the radiating element through the ground plane and the PDEBG structure.

In one embodiment, the conductive cavity has a floor that serves as the ground plane of the antenna.

In one embodiment, the antenna further comprises a radome layer covering an upper surface of the radiating element.

In one embodiment, an upper surface of the radome layer is substantially flush with an upper edge of the conductive cavity.

In one embodiment, an upper surface of the radiating element is substantially flush with an upper edge of the conductive cavity.

In one embodiment, the conductive cavity is formed within an outer skin of a vehicle; and an upper surface of the antenna is flush with the outer skin of the vehicle.

In one embodiment, the vehicle includes one of: a ground vehicle, a watercraft, an aircraft, and a spacecraft.

In one embodiment, a length, a width, and a height of the conductive cavity are each less than a wavelength at the center frequency of the antenna.

In one embodiment, the antenna is conformal to a curved surface of a mounting platform.

In one embodiment, the radiating element is a first radiating element; and the antenna further comprises a second radiating element disposed above the PDEBG structure, the second radiating element having a long dimension and a short dimension, the second radiating element having an orientation that is orthogonal to an orientation of the first radiating element, wherein the second radiating element is on a different metal layer than the first radiating element.

In accordance with another aspect of the concepts, systems, circuits, and techniques described herein, an antenna assembly for use in forming a rotationally polarized antenna, comprises: a polarization dependent electromagnetic band gap (PDEBG) structure having a plurality of unit cells arranged in rows and columns; and a radiating element disposed above the PDEBG structure, the radiating element having a long dimension and a short dimension, the radiating element being held in a fixed position with respect to the PDEBG structure so that the long dimension of the radiating element firms a non-zero angle with both the rows and columns of the PDEBG structure; therein the antenna assembly is configured for insertion into a conductive cavity having dimensions that are selected to form an antenna having radiation performance that is characteristic of a larger antenna.

In one embodiment, the PDEBG structure and the radiating element are formed on printed circuit boards.

In one embodiment, the antenna assembly further comprises a ground plane on an opposite side of the PDEBG structure from the radiating element, the ground plane to contact a floor of the conductive cavity when the antenna assembly is installed therein.

In one embodiment, the PDEBG structure is sized and positioned to form predetermined capacitances with walls of the conductive cavity when the antenna assembly is installed therein to form at least one additional resonance in an electrical response of the antenna that increases a bandwidth of the response above what it would be without the conductive cavity.

In one embodiment, the antenna assembly farther comprises a feed coupled to the radiating element through the PDEBG structure.

In one embodiment, the radiating element is a patch element.

In one embodiment, the radiating element is one of: a dipole element and a monopole element.

In one embodiment, the radiating element is oriented at an angle with respect to the rows and columns of the PDEBG structure that supports substantially equal horizontal and vertical electric field components for use with circularly polarized waves.

In one embodiment, the radiating element is oriented at an angle with respect to the rows and columns of the PDEBG structure that supports different horizontal and vertical electric field magnitudes for use with elliptically polarized waves.

In one embodiment, the antenna assembly is designed for insertion into a conductive cavity within an outer skin of a vehicle; and the antenna assembly has a height that allows the antenna assembly to be mounted in the conductive cavity substantially flush to the outer skin of the vehicle.

In one embodiment, the radiating element is a first radiating element; and the antenna assembly further comprises a second radiating element disposed above the PDEBG structure, the second radiating element having a long dimension and a short dimension, the second radiating element having an orientation that is orthogonal to an orientation of the first radiating element, wherein the second radiating element is on a different metal layer than the first radiating element.

In accordance with a still another aspect of the concepts, systems, circuits, and techniques described herein, a method is provided for designing a rotationally polarized antenna having a radiating element disposed above a polarization-dependent electromagnetic band gap (PDEBG) structure within a conductive cavity, the radiating element being oriented at a non-zero angle with respect to the PDEBG structure. More specifically, the method comprises: determining an approximate size of the conductive cavity; selecting a dielectric material and a number and arrangement of unit cells to use in the PDEBG structure that will fit within the approximate size of the conductive cavity; selecting a radiating element; designing a unit cell of the PDEBG structure that will result in a 90 degree phase shift between total horizontal and vertical electric field components of the antenna, wherein designing a unit cell takes into consideration performance effects of the conductive cavity on the operation of the PDEBG structure; and adjusting a size of at least the conductive cavity to achieve an enhanced bandwidth for the rotationally polarized antenna.

In one embodiment, designing a unit cell of the PDEBG structure includes using electromagnetic simulation software.

In one embodiment, designing a unit cell of the PDEBG structure includes modeling a capacitance between walls of the conductive cavity and edges of the PDEBG structure.

In one embodiment, the method further comprises selecting a second radiating element to be mounted above the PDEBG structure and the first radiating element, the second radiating element to be oriented in a direction that is orthogonal to an orientation direction of the first radiating element.

BRIEF DESCRIPTION OF THE DRAWINGS

The foregoing features may be more fully understood from the following description of the drawings in which.

DETAILED DESCRIPTION

Figure 1:
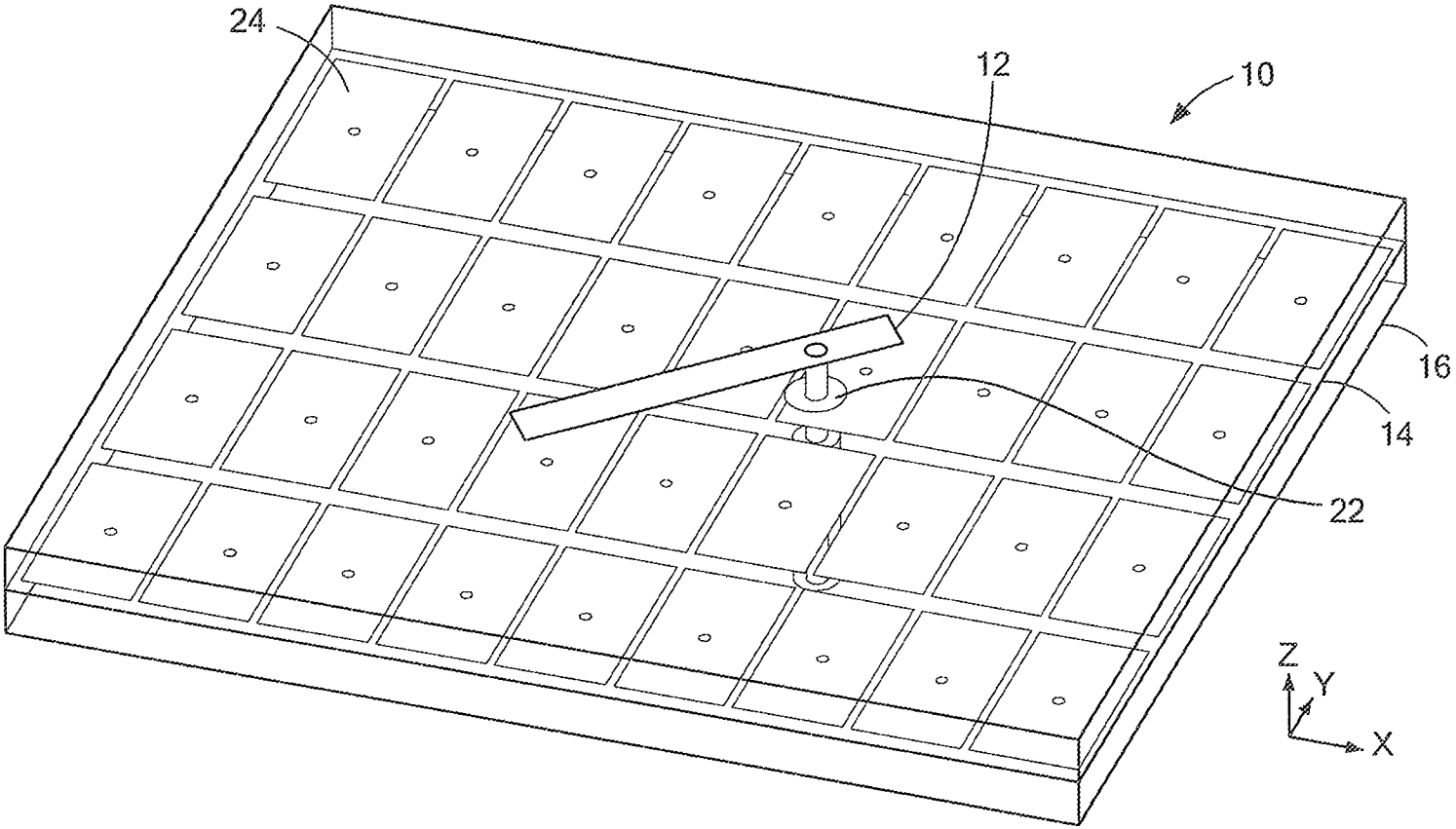
FIG. 1 is a projection view illustrating an exemplary antenna assembly in accordance with an embodiment.

The subject matter described herein relates to antenna designs that are capable of providing high gain and wide circular polarization (or elliptical polarization) bandwidth from a relatively small, low profile package. The antenna designs are particularly well suited for use in antenna applications requiring flush mounting (e.g., airborne applications, conformal arrays, etc). The antenna designs are also well suited for use in other applications where small antenna size is desired, such as hand held wireless communicators and wireless networking products. In some implementations, the antenna designs may be used to provide RMS antennas, although many other applications exist. Conventional low profile, limited volume, circularly-polarized antenna designs have suffered from narrow impedance bandwidth and narrow circular polarization bandwidths. For example, the typical 3 dB axial ratio bandwidth in such antennas is less than 2%. In at least one embodiment described herein, 3 dB axial ratio bandwidths of up to 15.58% have been achieved, with impedance bandwidths of up to 20.72%, in antenna systems that provide high gain, conformal mounting, and limited volume.

Although described in the context of circular polarization in various places herein, it should be appreciated that the techniques and structures described herein may also be used to support non-circular, elliptically polarized operation in some embodiments. As used herein, the terms "rotational polarization," "rotationally polarized," and the like are used to describe propagating waves having rotating electric field polarizations, such as elliptically polarized and circularly polarized waves, and structures for use therewith.

In various embodiments described herein, antennas are provided that include a radiating element held in a fixed orientation relative to a polarization-dependent electromagnetic band gap (PDEBG) structure, with both the radiating element and the PDEBG structure mounted within a conductive cavity. To support circular polarization, the radiating element may be oriented at a non-zero angle with respect to the PDEBG structure so that the total radiating fields of the antenna have substantially equal magnitude for x-polarization and y-polarization. To support non-circular elliptical polarization, the radiating element may be oriented at an angle that results in total radiating fields of the antenna that have unequal magnitude for x-polarization and y-polarization. For both circular and elliptical polarization, the PDEBG structure can be designed to achieve total radiating fields with 90° phase difference between x-polarization and y-polarization. As will be described in greater detail, the conductive cavity allows the antenna to be flush-mounted if desired and, with proper design, also permits an increase in rotationally polarized bandwidth to be achieved.

Electromagnetic band gap (EBG) structures are periodic structures that exhibit interesting qualities in the presence of electromagnetic waves. A polarization-dependent electromagnetic band gap (PDEBG) structure is an EBG structure that has response characteristics that depends upon the polarization of an incident electromagnetic wave. That is, the PDEBG will respond differently to a horizontally polarized wave at a particular frequency than it will to a vertically polarized wave at the same frequency. One property of EBG structures that has proven very useful in the field of antennas is the ability to, at least in part, act as a magnetic conductor surface. As is well known, an electromagnetic wave incident upon a perfect electric conductor surface will be reflected with a phase change of 180 degrees. Conversely, an electromagnetic wave incident upon a perfect magnetic conductor surface, if such a thing could exist, would be reflected with a phase change of zero degrees. EBG structures can be designed that reflect electromagnetic waves at desired angles between zero and 180 degrees. In addition, it is also possible to design EBG structures that reflect electromagnetic waves having a first polarization direction (e.g., horizontal) at one phase angle and electromagnetic waves having a second polarization direction (e.g., vertical) at a different phase angle. As will be described in greater detail, these properties can be taken advantage of by an antenna designer to achieve an antenna capable of circularly polarized operation.

In the discussion that follows, a right-hand Cartesian coordinate system (CCS) will be assumed when describing the various antenna structures. To simplify description, the direction normal to the face of an antenna will be used as the z-direction of the CCS (with unit vector z), the direction along a longer side of the antenna will be used as the x-direction (with unit vector x), and the direction along a shorter side of the antenna will be used as the y direction (with unit vector y). It should be appreciated that the structures illustrated in the various figures disclosed herein are not necessarily to scale. That is, one or more dimensions in the figures may be exaggerated to, for example, increase clarity and facilitate understanding.

FIG. 1 is a projection view illustrating an exemplary antenna assembly 10 in accordance with an embodiment. As will be described in greater detail, the antenna assembly 10 may be installed within a conductive cavity to form as completed antenna. As illustrated, the antenna assembly 10 includes a radiating element 12 mounted above a polarization-dependent electromagnetic band gap (PDEBG) structure 14. A ground plane 16 may be provided below the PDEBG structure 14. The PDEBG structure 14 may include a plurality of units cells 24 that are arranged in a periodic fashion (e.g., equally spaced rows and columns). The size, shape, and proximity of the various unit cells 24 will, to a large extent, dictate the operational properties of the PDEBG structure 14. A feed 22 may be provided to feed the radiating element 12. In the illustrated embodiment, the feed 22 is a coaxial feed that extends through the PDEBG structure 14 and the ground plane 16 from below. Other techniques for feeding the radiating element 12 may alternatively be used. To facilitate operation with circularly-polarized signals, as will be described in greater detail, the radiating element 12 may be oriented at a non-zero angle with respect to the units cells 24 of the PDEBG structure 14 (i.e., at a non-zero angle with respect to the x and y axes in FIG. 1).

Figure 2:
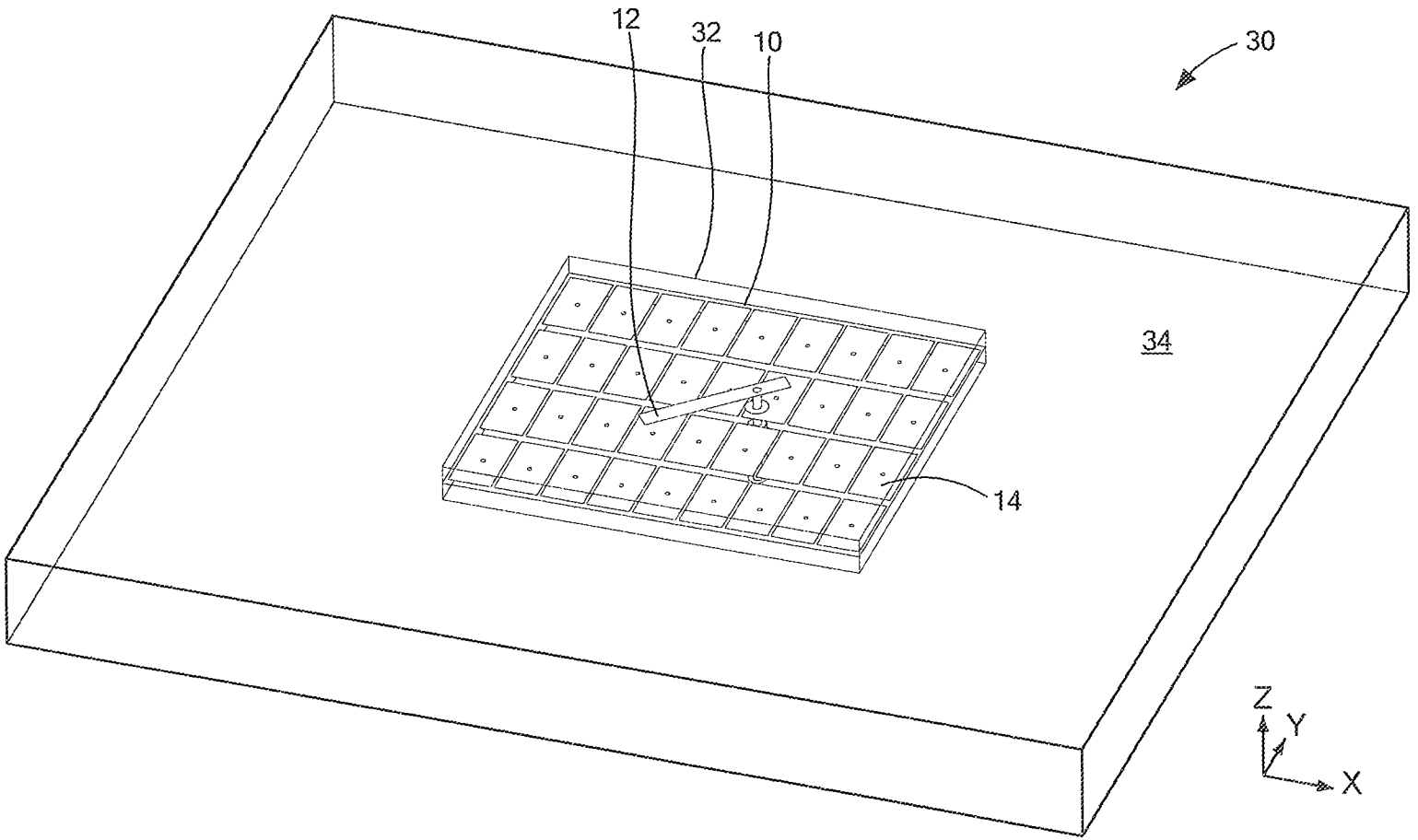
FIG. 2 is a projection view illustrating an exemplary antenna having the antenna assembly of FIG. 1 mounted within a conductive cavity in accordance with an embodiment.

FIG. 2 is a projection view showing the antenna assembly 10 of FIG. 1 mounted within a conductive cavity 32 to form an antenna 30 in accordance with an embodiment. In some implementations, the antenna assembly 10 may be mounted within the conductive cavity 32 so that an outermost surface of the antenna assembly 10 is flush with a surface 34 associated with the conductive cavity 32 (e.g., a conductive surface within which the cavity 32 is formed). As is well known, flush mounting may be desired to reduce the aerodynamic impact of the antenna 30 in certain applications. The antennas and techniques described herein are not limited to use in flush mounted applications, however. In some embodiments, the conductive cavity 32 may include, for example, a depression within an outer conductive skin 34 of a vehicle (e.g., ground vehicle, an aircraft, a missile, a spacecraft, a watercraft, etc.).

The antenna assembly 10 may be fixed within the conductive cavity 32 in any known manner including using, for example, an adhesive, solder, a compression fit, clamps, or any other technique that is capable of securing the assembly 10 in place. In some embodiments, instead of first forming the antenna assembly 10 and then mounting it within the cavity 32, the PDEBG structure 14 and the radiating element 12 may be assembled within the conductive cavity 32. In the illustrated embodiment, an elongated patch radiating element 12 is used in the antenna 30. It should be appreciated, however, that any type of element may be used that can operate as a linear electric field source.

With reference to FIG. 2, to support circularly-polarized operation, the PDEBG structure 14 may be designed so that the reflection phase of the structure is dependent on the polarization of an incident wave. Thus, a horizontally polarized electromagnetic wave will be reflected by the PDEBG structure 14 with a first phase angle and a vertically polarized wave will be reflected with a second phase angle that is different from the first phase angle. The radiating element 12 is mounted at a non-zero angle with respect to the x and y axes so that a transmitted signal has both a horizontal and a vertical electric field component. Portions of the transmitted signal will travel backwards (i.e., in the −z direction) from the radiating element 12 and be reflected from the PDEBG structure 14. The horizontal and vertical components of the signal will be reflected at different phases. The antenna 30 may be designed so that the difference between the overall horizontal electric field component and the overall vertical electric field component emitted from the antenna will be (nominally) 90 degrees out of phase within a frequency range of interest. As is well known, a circularly polarized signal requires the combination of two orthogonally polarized signals that are 90 out of phase with one another. To support circularly-polarized operation, the orientation of the radiating element 12 with respect to the x and y axes may be selected to achieve a substantially equal electric field magnitude in the horizontal and vertical electric field components. To support elliptically-polarized operation (non-circular), the orientation of the radiating element 12 with respect to the x and y axes may be selected to achieve different electric field magnitudes in the horizontal and vertical directions.

Figure 3:
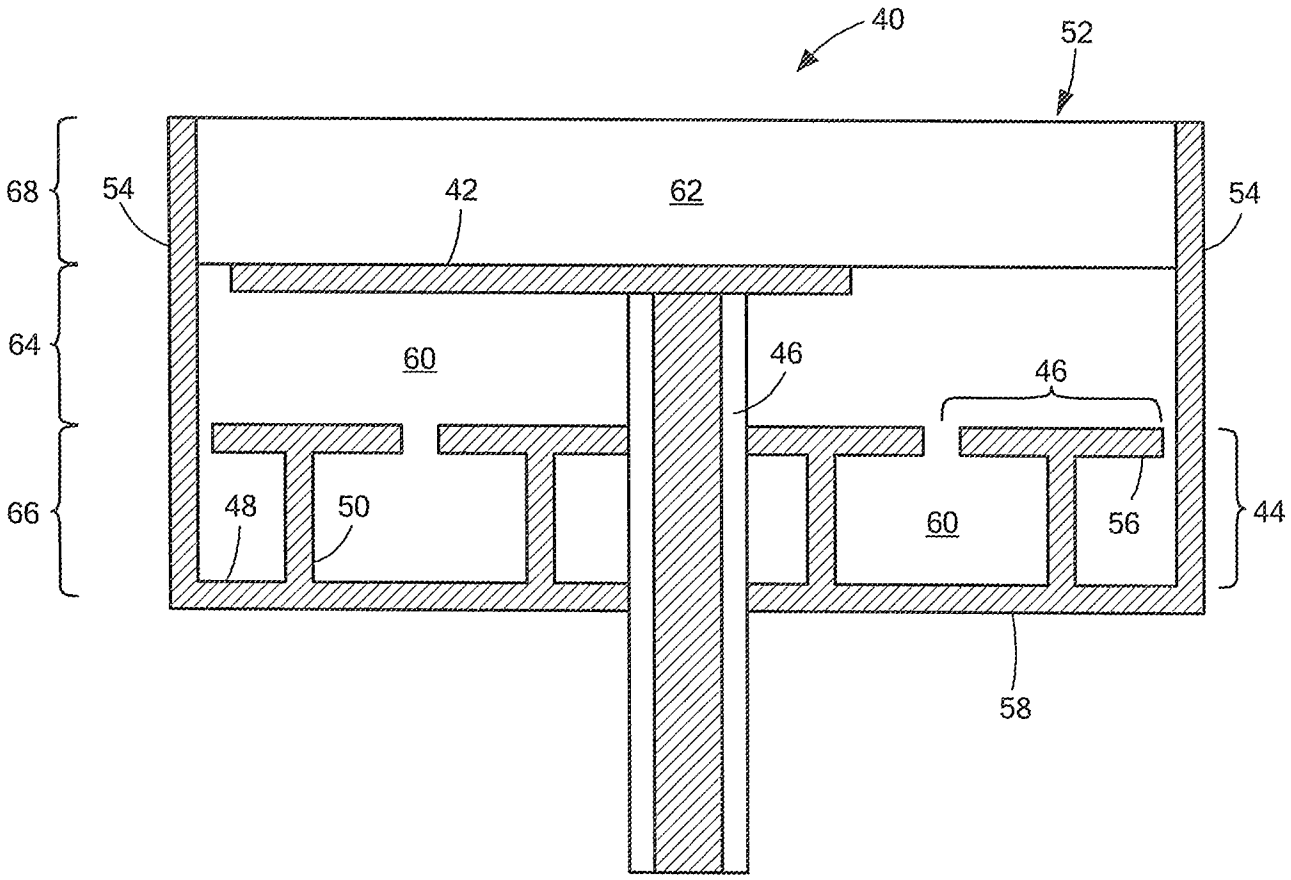
FIG. 3 is a sectional side view of an exemplary antenna in accordance with an embodiment.

FIG. 3 is a sectional side view of an antenna 40 in accordance with an embodiment. As shown, the antenna 40 includes a radiating element 42 disposed above a PDEBG structure 44, within a conductive cavity 52. The PDEBG structure 44 includes a plurality of unit cells 46 situated above a ground plane 48. Each unit cell 46 includes a horizontal, conductive EBG element 56 that is conductively coupled to the ground plane 48 by a conductive connection 50. In the illustrated embodiment, the PDEBG structure 44 is a particular form of EBG structure known as a mushroom EBG. It should be understood that other types of EBG structures that support circular polarized waves may be used in other embodiments. A coaxial feed 46 is provided to feed the radiating element 42 from below. As shown, the coaxial feed 46 extends through the ground plane 48 and the PDEBG structure 44.

The conductive cavity 52 of FIG. 3 includes wall portions 54 and a floor portion 58. The wall portions 54 may surround the radiating element 42 and the PDEBG structure 44 on all sides. The antenna 40 will transmit and/or receive electromagnetic signals through a top of the cavity 52 which remains open. In some embodiments, the floor portion 58 of the conductive cavity 52 may serve as the ground plane 48 of the antenna. In other embodiments, a separate ground plane 48 may be provided. Dielectric material 60 may fill the gaps between the conductive elements of the antenna 40. A dielectric radome 62 may be provided above the radiating element 42 to, among other things, protect the radiating element 42 and other circuitry from an exterior environment. In some implementations, an upper surface of the radome 62 may be flush with an upper edge of the cavity 52 (although this is not required).

The antenna designs of FIGS. 1, 2, and 3 may be built in any of a variety of ways. In some embodiments, these designs may be formed using relatively simple and well known printed circuit board (PCB) techniques. Thus, with reference to FIG. 3, radiating element 42 may include a metallic trace patterned on an upper surface of as first dielectric board 64 and the conductive elements 56 of the PDEBG structure 44 may include metallic traces patterned on an upper surface of a second dielectric board 66. The ground plane 48 may include a metallization layer on a lower surface of the second dielectric board 66. The conductive connections 50 may be formed using via connections (plated-through holes) extending through the second dielectric board. A lamination process may be used to fuse together the first and second dielectric boards 63, 66 to form a multi-layer board assembly. In some implementations, another layer of dielectric board material 68 may be laminated over the top of the radiating element 42 to serve as the radome 62.

As described previously, the conductive cavity 52 within which the radiating element 42 and the PDEBG structure 44 are housed may consist of a recess within a conductive surface associated with a mounting platform (e.g., a vehicle, etc.). In some embodiments, however, the walls 54 and the floor 58 of the cavity 52 may be deposited or otherwise formed about the other elements of the antenna 40 before mounting. The resulting assembly, with the cavity walls already formed, may then be mounted to a mounting surface. Other techniques for forming the antenna structures of FIGS. 1, 2, and 3 may alternatively be used as long as the dimensions, geometries, and structures are maintained. These other techniques may include, for example, additive manufacturing (e.g., 3D printing), direct energy deposition, 3D lamination, and/or others.

With reference to FIG. 3, to achieve enhanced performance characteristics, the radiating element 42, the PDEBG structure 44, and the conductive cavity 52 are designed together. Traditionally, it has been considered a detriment to mount an antenna within a cavity. That is, the overall performance of the resulting antenna was invariably thought to be worse than the performance of the same antenna without a cavity. It has been found, however, that careful design of all elements together can result in an antenna within a cavity that has performance characteristics that exceed those of a similar antenna without a cavity. In some cases, an antenna can be achieved that performs like a much larger antenna, but within a smaller, more compact package. As will be described in greater detail, the design must take into account the effects that the cavity may have on the operation of other components of the antenna. This may include, for example, performance effects caused by capacitances between the walls 54 of the cavity 52 and the unit cells 46 of the EBG structure 44. In some embodiments, this may also include performance effects of capacitances between the walls 54 of the cavity 52 and the radiating element 42. In at least one implementation, the cavity 52 is used as an additional design variable to tune the antenna 40 for broadband operation. It was found that careful design of cavity size, along with proper placement of structures within the cavity, can permit an additional resonance to be achieved that can be used to broaden the operational bandwidth of the antenna for circularly polarized operation.

Figure 4:
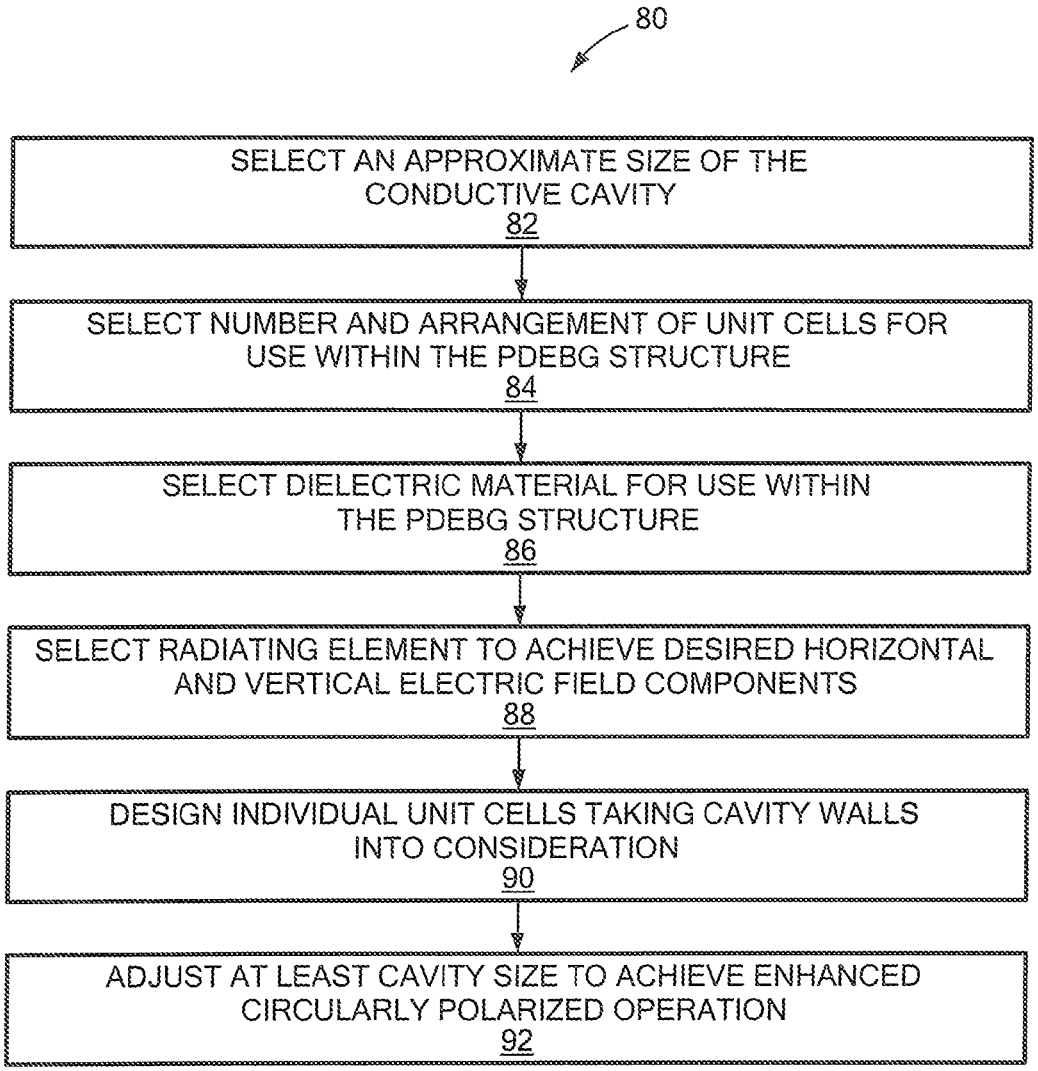
FIG. 4 is a flowchart illustrating an exemplary method for designing an antenna in accordance with an embodiment.

FIG. 4 is a flowchart illustrating an exemplary method for designing an antenna in accordance with an embodiment. As shown, an approximate size of the conductive cavity of the antenna may first be determined (block 82). This approximate size may be dictated by, for example, the intended deployment location of the antenna or some other system requirement. Next, a number and arrangement of unit cells to use in the PDEBG structure may be selected (block 84). A dielectric material may also be selected that will allow this arrangement of unit cells to fit within the approximate cavity size (block 66). At some point, a radiating element may be selected to achieve desired horizontal and vertical field magnitudes for the antenna (e.g., equal field magnitudes to achieve circular polarization) (block 88). The type of radiating element, as well as the size, shape, and orientation of the element, may be selected. The design of the individual unit cells may next be undertaken (block 90). Modeling may be done to determine the correct phase response of the PDEBG structure to produce a 90 degree phase shift between total horizontal and vertical electric field components for the antenna. During this stage, the modeling may take into account the presence of the cavity walls and changes can be made to, for example, the dielectric material, the size of the unit cell elements, the size of the cavity, and/or other parameters to find values that work together to achieve an enhanced circularly polarized bandwidth (block 92). Although illustrated in a particular order in FIG. 4, it should be understood that changes may be made to the order of the blocks in different implementations. In addition, it should be understood that two or more of the blocks may be implemented concurrently in various implementations. Computer design tools/software may be used to facilitate the modeling and design process in some embodiments (e.g., the Ansys HFSS™ 3D electromagnetic simulation tool, etc.).

In a typical EBG structure, there will be a capacitance between adjacent pairs of units cell elements. During the design process, the cavity may be thought of as providing additional capacitance (e.g., capacitance between the walls of the cavity and the outermost unit cells of the EBG structure) that can be used as a degree of freedom in the design. This capacitance may be adjusted by, for example, changing the distance between the cavity walls 54 and the outermost unit cells of the EBG structure. It was found that by appropriately selecting this capacitance, the EBG structure 44 could be made to appear as though it had an image of additional rows and columns of unit cells. By making the EBG structures appear larger, the effective aperture appears larger and enhanced circularly polarized bandwidth can be achieved in the antenna. Properly selected, this additional capacitance can produce an additional resonance in the design that serves to increase the bandwidth over which circularly polarized operation is possible.

If the width of the cavity is adjusted with respect to the EBG, the side capacitance will change and this will impact the second resonance right hand response of the antenna. Similarly, if the length of the cavity is adjusted with respect to the EBG, the corresponding capacitance will change and this will impact the second resonance left hand response of the antenna. If both the length and the width of the cavity are tuned together and tuned with the other antenna parameters, a second resonance may be achieved to produce an overall wideband response.

Figure 5:
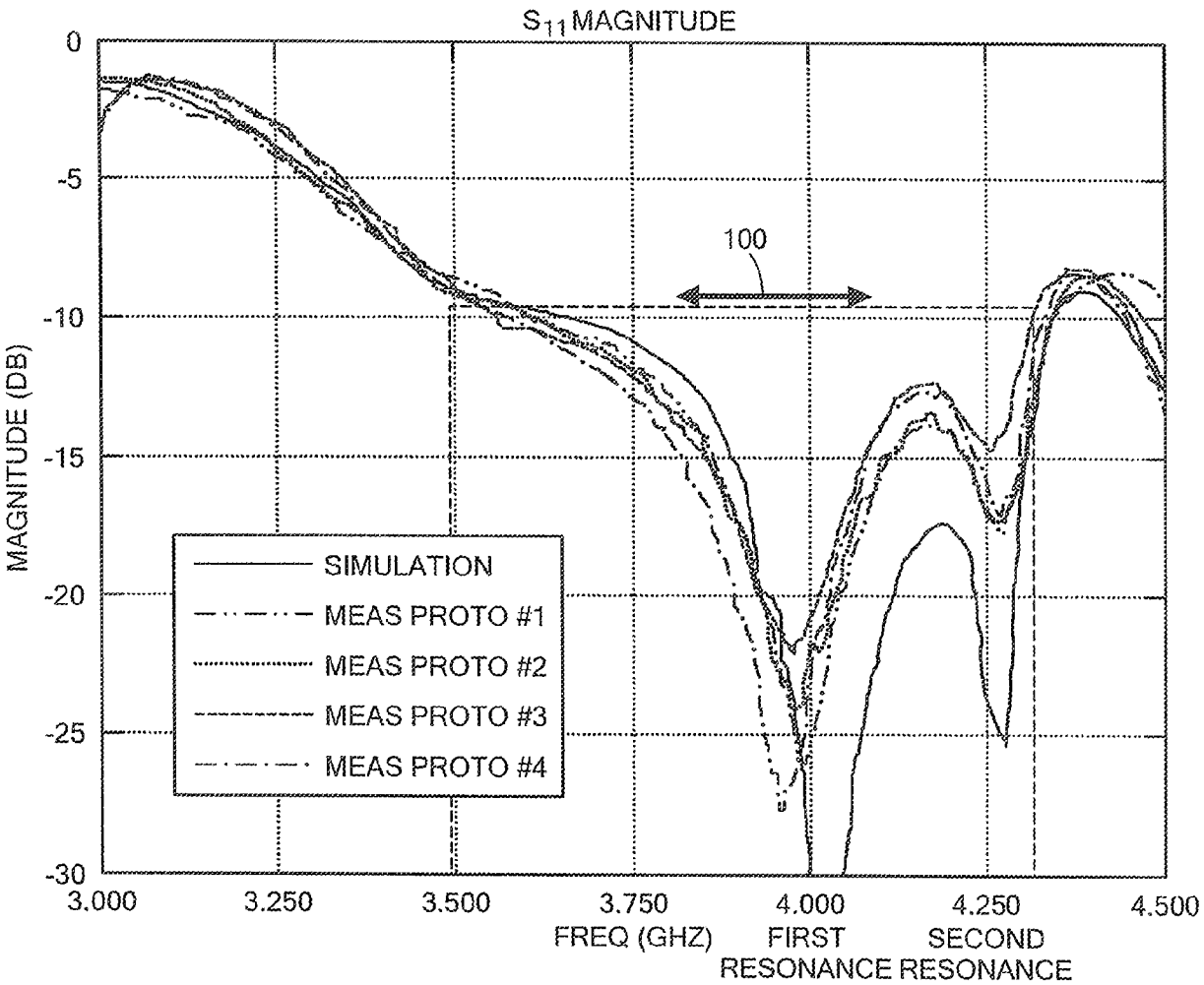
FIG. 5 is a plot illustrating an input impedance response of an exemplary antenna design in accordance with an embodiment.

FIG. 5 is a plot illustrating an input impedance response (S11) of an exemplary antenna design in accordance with an embodiment. The plot includes both a simulated response curve and measured prototype response curves for the antenna design. As shown, the measured results agree well with the simulation. A wide impedance bandwidth of approximately 20.72 percent is achieved in the antenna. This impedance bandwidth is adequate for most modern data link systems. As shown in the FIG. 5, this impedance bandwidth is significantly larger than the bandwidth 100 achieved in a prior EM coupled, circularly polarized antenna design. A second resonance is achieved at about 4.25 GHz by designing the cavity, the PDEBG structure, and the radiating element to work together.

Figure 6:
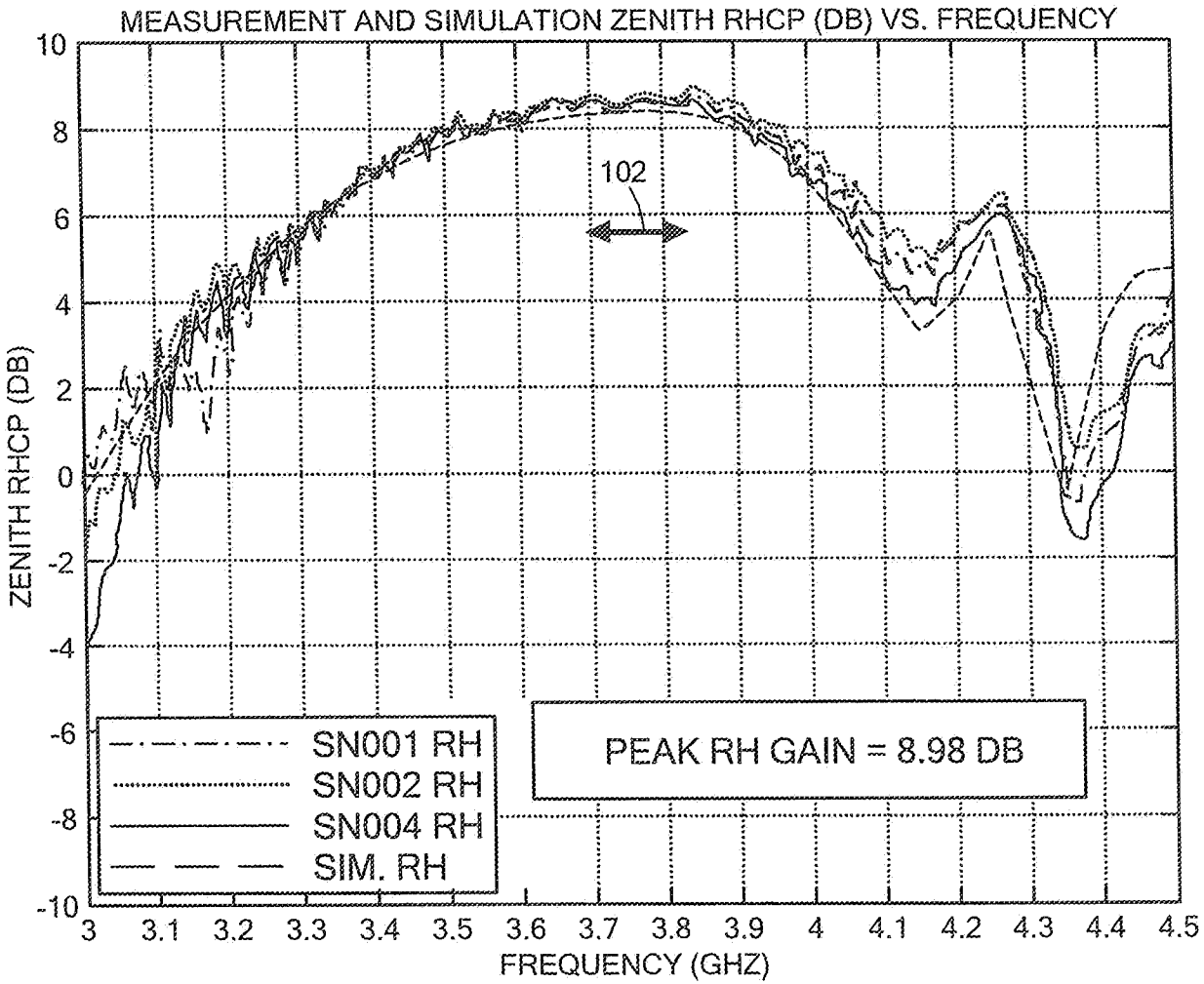
FIG. 6 is a plot illustrating antenna gain at zenith for right hand circular polarization (RHCP) operation versus frequency for the exemplary antenna design.
Figure 7:
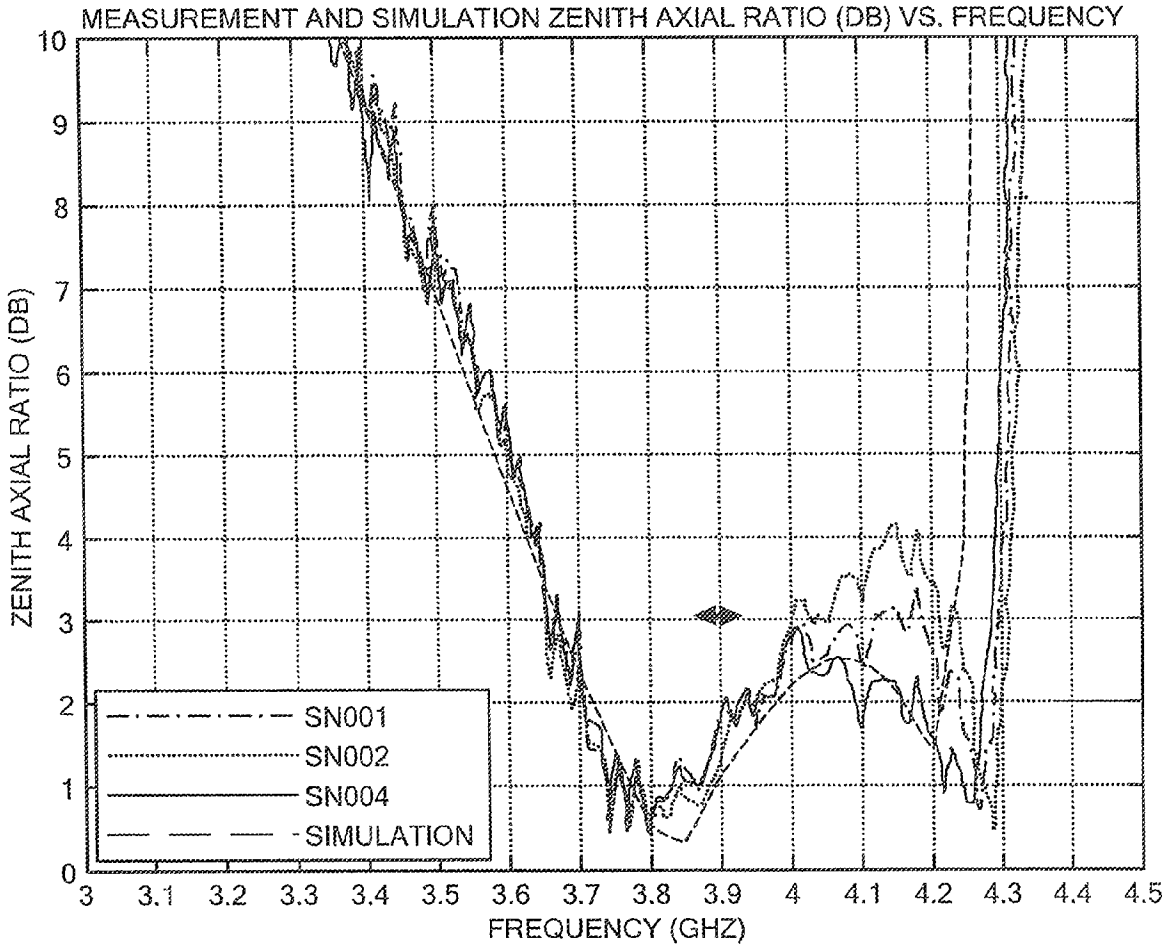
FIG. 7 is a plot illustrating axial ratio (AR) at zenith versus frequency for the exemplary antenna design.

FIG. 6 is a plot showing antenna gain at zenith for right hand circular polarization (RHCP) operation versus frequency for the exemplary antenna design. Again, both simulated and measured results are shown. The plot shows that a peak RH gain of approximately 8.98 dB was achieved by the design. The 6 dB bandwidth of the gain response of FIG. 6 is significantly larger than the bandwidth 102 of the prior EM coupled, circularly polarized antenna design. FIG. 7 is a plot showing the axial ratio (AR) at zenith versus frequency for the exemplary antenna design. Simulated and measured results are shown. The plot of FIG. 7 shows that a 6 dB AR bandwidth of approximately 19.08 percent was achieved by the design. This translates to a 6 dB AR angular coverage of +/−60°. Similarly, a 3 dB AR bandwidth of 15.58 percent was achieved. These AR bandwidths are significantly larger than those of the prior EM coupled, circularly polarized antenna design. This translates to a 3 dB AR angular coverage of +/−40°.

Figure 8:
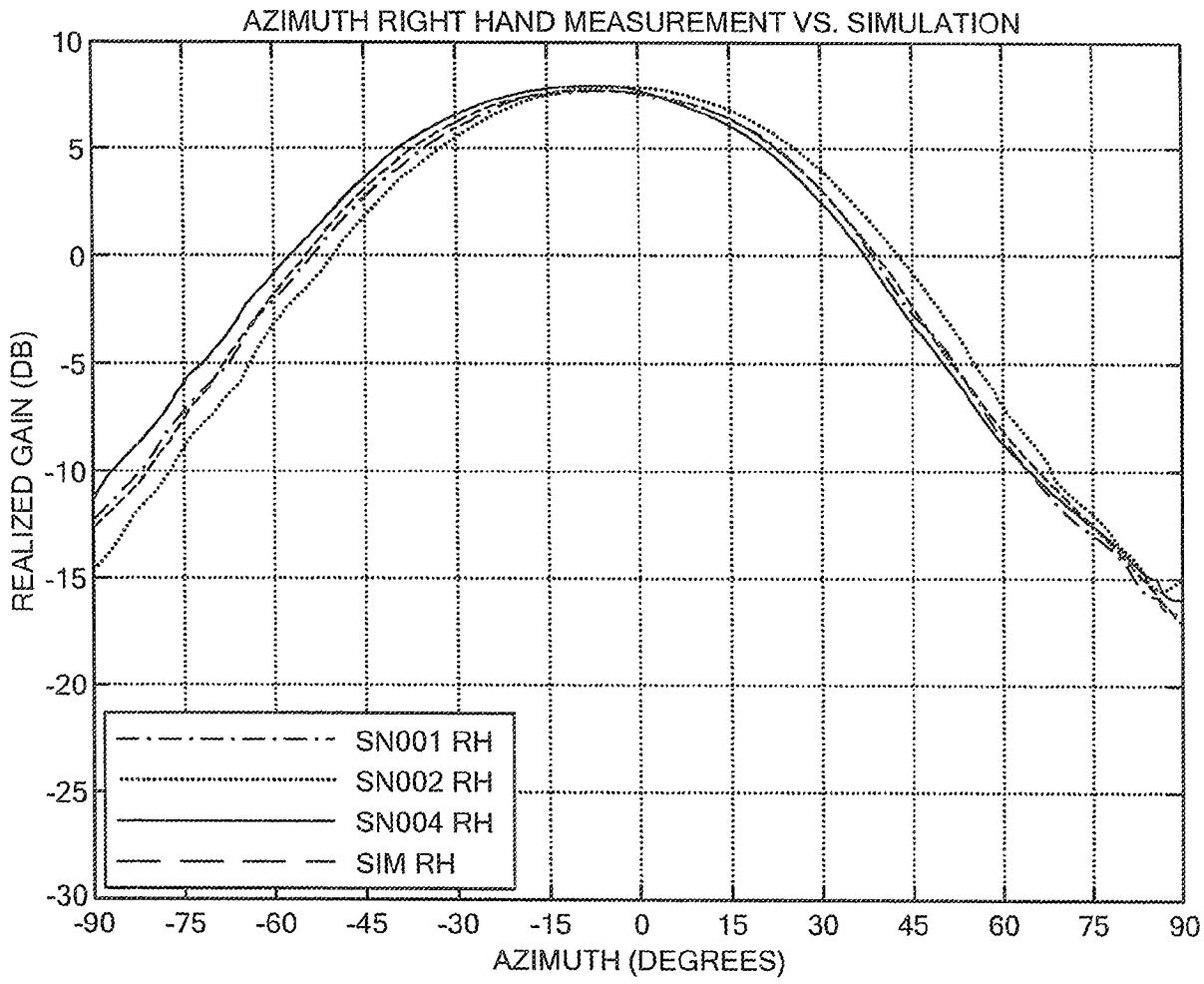
FIG. 8 is a plot illustrating gain versus azimuth angle for right hand circular polarization (RHCP) operation for the exemplary antenna design.
Figure 9:
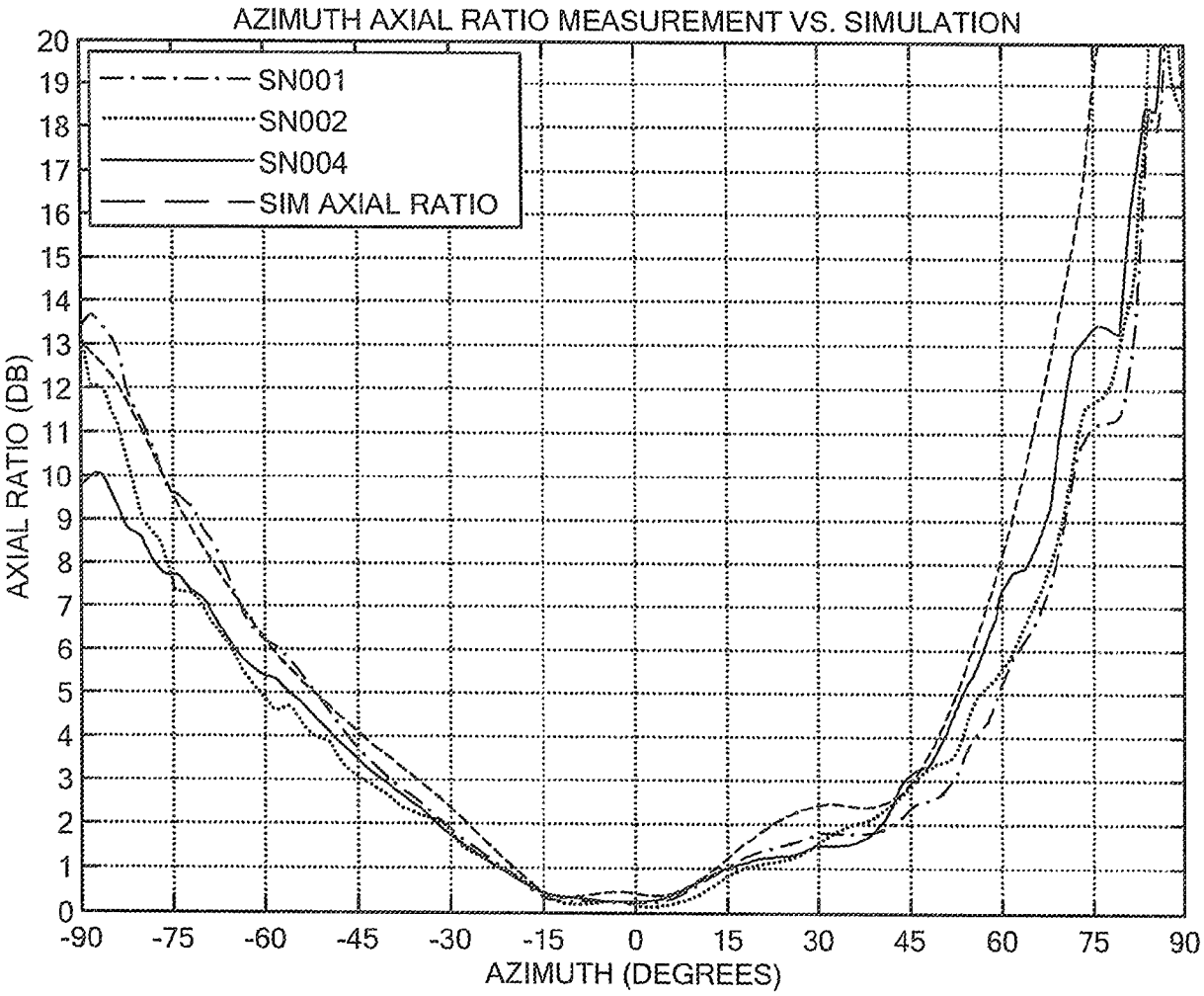
FIG. 9 is a plot illustrating axial ratio (AR) versus azimuth angle for the exemplary antenna design.
Figures 10, 11:
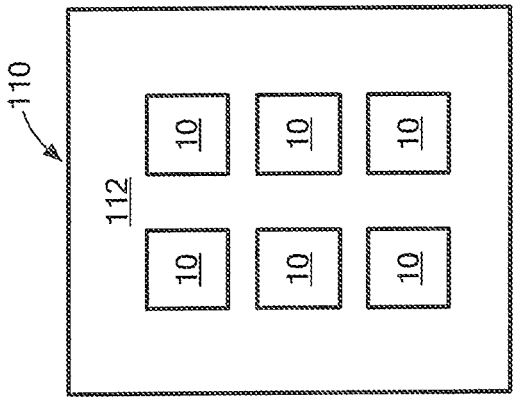
FIG. 10 is a table comparing operational parameters of the exemplary antenna design to those of a prior EM coupled, circularly polarized antenna design.
FIG. 11 is a front view illustrating an exemplary array antenna in accordance with an embodiment.

FIG. 8 is a plot showing gain versus azimuth angle for right hand circular polarization (RHCP) operation for the exemplary antenna design. FIG. 9 is a plot showing axial ratio versus azimuth angle for the exemplary antenna design. Both simulated and measured results are shown. In each of these plots, the measured results closely match the simulations. FIG. 10 is a table comparing the operational parameters of the exemplary antenna design to those of the prior EM coupled, circularly polarized antenna design.

In some embodiments, multiple polarization dependent electromagnetic band gap (PDBG) antennas are implemented together as an array antenna. FIG. 11 is a diagram illustrating an exemplary array antenna 110 in accordance with an embodiment. As shown, array antenna 110 includes a number of antenna assemblies (e.g., antenna assembly 10 of FIG. 1, etc.) installed within corresponding cavities of as mounting surface 112. As described previously, in some embodiments, the mounting surface 112 may be the exterior skin of a vehicle or other mounting platform. The antenna assemblies 10 may be flush mounted within the various cavities to reduce problems related to, for example, wind drag. In some embodiments, however, flush mounting is not used. One or more beamformers may be coupled to the various antenna assemblies for use in forming beams using the various antenna elements. Because each of the elements of the array antenna 110 are housed within cavities, cross talk between the elements will typically be lower than it would be without cavities.

Figure 12:
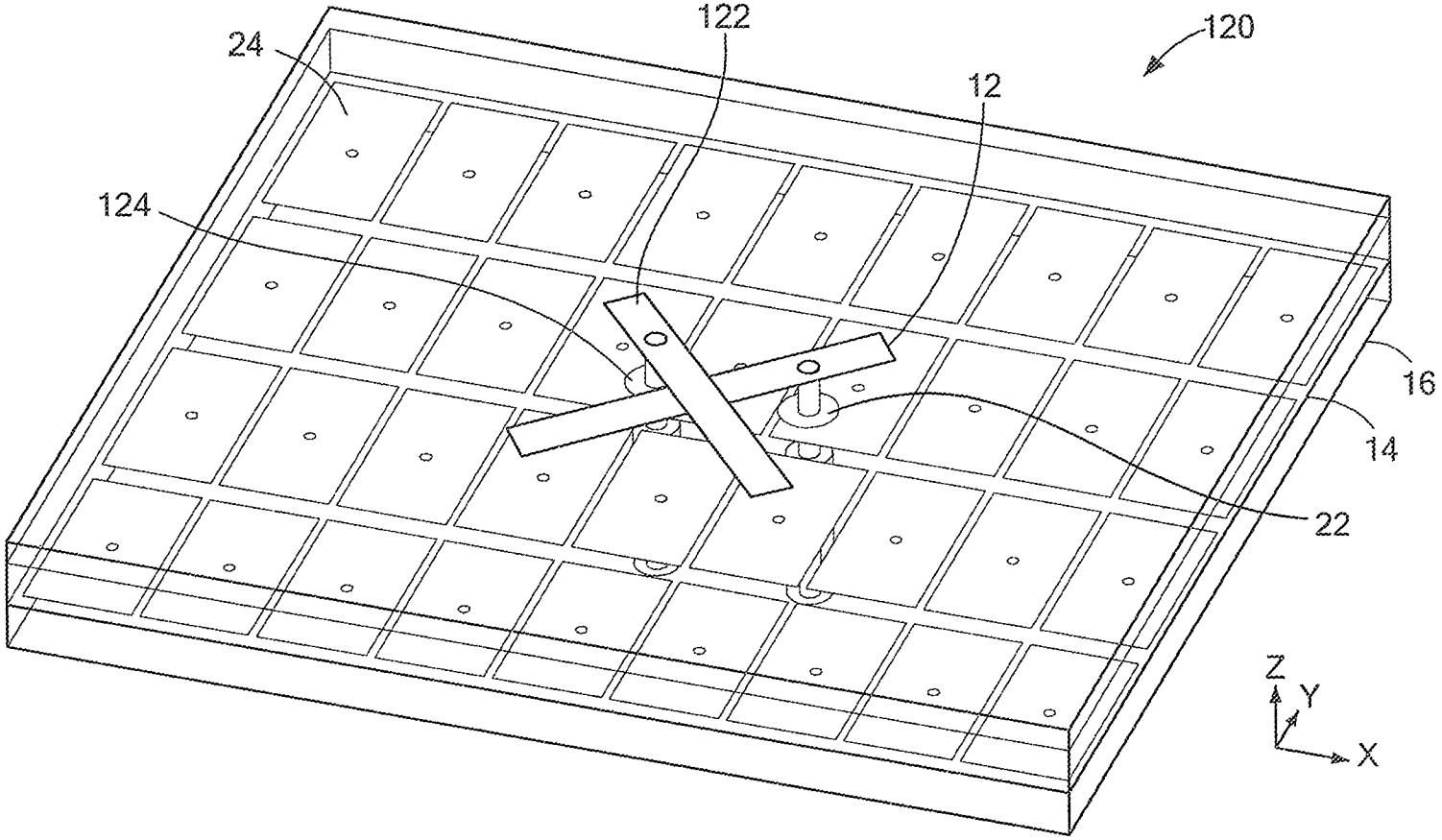
FIG. 12 is a projection view illustrating an exemplary antenna assembly having two radiating elements in accordance with an embodiment.

FIG. 12 is a projection view illustrating an exemplary antenna assembly 120 in accordance with another embodiment. The antenna assembly 120 of FIG. 12 is similar to the antenna assembly 10 of FIG. 1, except an additional radiating element 122 has been added above the PDEBG structure 14. An additional feed 124 is also provided to feed the additional radiating element 122. The feed 124 may include a coaxial feed that extends through the PDEBG structure 14 and the ground plane 16 from below or some other type of feed structure. The additional radiating element 122 may be oriented in a direction that is orthogonal to the orientation of the first radiating element 12. Further, the additional radiating element 122 may be located on a different metal layer of the antenna assembly 120 than the first radiating element 12 (e.g., a higher layer, etc.). In some implementations, one or more dielectric radome layers may be mounted above the uppermost radiating element (e.g., above radiating element 122 in FIG. 12).

The antenna assembly 120 may be mounted within a cavity as described previously (e.g., cavity 32 of FIG. 2, etc) to form a completed antenna. In addition, the antenna assembly 120 and the cavity in which it is mounted may be designed together to achieve enhanced rotational polarization performance (e.g., circularly polarized bandwidth, etc.). As described previously, in some implementations, this may involve adjusting dimensions of the cavity 52 as an additional design variable to tune the overall antenna for broadband operation. In some embodiments, a number of antenna assemblies 120 may be mounted within an array of cavities to form an antenna array (similar to, for example, array 110 of FIG. 11).

As described previously, the first radiating element 12 may be oriented at a non-zero angle with respect to the units cells 24 of the PDEBG structure 14 to facilitate operation with circularly-polarized or elliptically polarized signals. Similarly, the second radiating element 122 may be oriented at a non-zero angle with respect to the units cells 24 of the PDEBG structure 14 to facilitate operation with circularly-polarized or elliptically polarized signals. In addition, as described above, the first and second radiating elements 12, 122 may be oriented in orthogonal directions to one another. The antenna 30 of FIG. 2 is capable of achieving either left hand rotational polarization or right hand rotational polarization. An antenna using the antenna assembly 120 of FIG. 12 within a cavity can achieve any combination of left hand operation, right hand operation, or elliptical operation by switching between the feeds or simultaneously exiting both feed elements. In addition, this can all be done with the increased performance provided by the tuned cavity capacitance.

The techniques and structures described herein may be used, in some implementations, to generate conformal antennas or antenna arrays that conform to a curved surface on the exterior of a mounting platform (e.g., a missile, an aircraft, etc.). When used in conformal applications, the structures described above can be re-optimized for a conformal cavity. Techniques for adapting an antenna design for use in a conformal application are well known in the art and typically include re-tuning the antenna parameters for the conformal surface.

The antenna designs and design techniques described herein have application in a wide variety of different applications. For example, the antennas may be used as active or passive antenna elements for missile sensors that require wide circular polarization bandwidth, higher CP gain to support link margin, and wide impedance bandwidth to support higher data-rates, within a small volume. They may also be used as antennas for land-based, sea-based, or satellite communications. Because antennas having small antenna volume are possible, the antennas are well suited for use on small missile airframes. The antennas may also be used in, for example, handheld communication devices (e.g., cell phones, smart phones, etc.), commercial aircraft communication systems, automobile-based communications systems (e.g., personal communications, traffic updates, emergency response communication, collision avoidance systems, etc.), Satellite Digital Audio Radio Service (SDARS) communications, proximity readers and other RFID structures, radar systems, global positioning system (GPS) communications, and/or others. In at least one embodiment, the antenna designs are adapted for use in medical imaging systems. The antenna designs described herein may be used for both transmit and receive operations. Many other applications are also possible.

As used herein, the phrases "circularly polarized," "circular polarization," and the like are not intended to imply perfect circular polarization but, instead, may refer to situations where a relatively low axial ratio is achieved. Thus, phrases such as "a high circularly polarized bandwidth" and the like are used to refer to scenarios where a relatively low axial ratio is maintained over a relatively large frequency range. Such phrases are not meant to be limited to situations where perfect circular polarization (i.e., axial ratio equals 1) is achieved over an extended bandwidth. In some embodiments, an antenna may be provided that is configured to achieve elliptically polarized operation (non-circular). In these embodiments, parameters such as the angle of the rotated radiating element (e.g., the rotated patch element 12 of FIG. 1), the reflected phase of the PDEBG structure, and others may be designed to achieve as desired level of elliptical polarization.

Having described exemplary embodiments of the invention, it will now become apparent to one of ordinary skill in the art that other embodiments incorporating their concepts may also be used. The embodiments contained herein should not be limited to disclosed embodiments but rather should be limited only by the spirit and scope of the appended claims. All publications and references cited herein are expressly incorporated herein by reference in their entirety.

What is claimed is:

1. A rotationally polarized antenna comprising:

a ground plane;

a polarization dependent electromagnetic band gap (PDEBG) structure disposed above the ground plane, the PDEBG structure having a number of unit cells arranged in rows and columns;

an orientable radiating element disposed above the PDEBG structure, the orientable radiating element having a long dimension and a short dimension; and a conductive cavity encompassing the PDEBG structure and the orientable radiating element, the conductive cavity being open on a radiating side of the antenna, wherein a distance between side walls of the conductive cavity and one or more outermost edges of the PDEBG structure produces an additional resonance in an electrical response of the antenna, the distance selected to increase (i) an effective aperture of the antenna and (ii) a bandwidth of the antenna, in relation to the effective aperture and bandwidth without the additional resonance;

wherein the orientable radiating element is oriented at a non-zero angle with respect to the rows and columns of the PDEBG structure, the angle selected such that the orientable radiating element supports one of: (i) substantially equal horizontal and vertical electric field magnitudes for use with circularly polarized waves, and (ii) different horizontal and vertical electric field magnitudes for use with non-circular elliptically polarized waves.

2. The antenna of claim 1, wherein:

the antenna is configured for use with circularly polarized waves.

3. The antenna of claim 1, wherein:

the PDEBG structure, the orientable radiating element, and the conductive cavity are configured together to achieve an enhanced operational bandwidth.

4. The antenna of claim 1, wherein:

the orientable radiating element includes one of: a patch element, a dipole element, and a monopole element.

5. The antenna of claim 1, further comprising:

a feed coupled to the orientable radiating element through the ground plane and the PDEBG structure.

6. The antenna of claim 1, wherein:

the conductive cavity has a floor that serves as the ground plane of the antenna.

7. The antenna of claim 1, further comprising:

a radome layer covering an upper surface of the orientable radiating element.

8. The antenna of claim 7, wherein:

an upper surface of the radome layer is substantially flush with an upper edge of the conductive cavity.

9. The antenna of claim 1, wherein:

an upper surface of the orientable radiating element is substantially flush with an upper edge of the conductive cavity.

10. The antenna of claim 1, wherein:

the conductive cavity is formed within an outer skin of a vehicle; and an upper surface of the antenna is flush with the outer skin of the vehicle.

11. The antenna of claim 10, wherein:

the vehicle includes one of: a ground vehicle, a watercraft, an aircraft, and a spacecraft.

12. The antenna of claim 1, wherein:

a length, a width, and a height of the conductive cavity are each less than a wavelength at the center frequency of the antenna.

13. The antenna of claim 1, wherein:

the antenna is conformal to a curved surface of a mounting platform.

14. The antenna of claim 1, wherein:

the orientable radiating element is a first orientable radiating element; and the antenna further comprises a second orientable radiating element disposed above the PDEBG structure, the second orientable radiating element having a long dimension and a short dimension, the second orientable radiating element having an orientation that is orthogonal to an orientation of the first orientable radiating element, wherein the second orientable radiating element is on a different metal layer than the first orientable radiating element.

15. The rotationally polarized antenna of claim 1, wherein the distance is selected by adjusting at least one of a length and a width of the conductive cavity relative to the PDEBG structure.

16. An antenna assembly for use in forming a rotationally polarized antenna, comprising:

a polarization dependent electromagnetic band gap (PDEBG) structure having a plurality of unit cells arranged in rows and columns; and an orientable radiating element disposed above the PDEBG structure, the orientable radiating element having a long dimension and a short dimension, the orientable radiating element being held in a fixed position with respect to the PDEBG structure so that the long dimension of the orientable radiating element forms a non-zero angle with both the rows and columns of the PDEBG structure, the non-zero angle selected such that the orientable radiating element supports one of: (i) substantially equal horizontal and vertical electric field magnitudes for use with circularly polarized waves, and (ii) different horizontal and vertical electric field magnitudes for use with non-circular elliptically polarized waves;

wherein the antenna assembly is configured for insertion into a conductive cavity having dimensions that are selected to form an antenna having radiation performance that is characteristic of a larger antenna, wherein a distance between side walls of the conductive cavity and one or more outermost edges of the PDEBG structure produces an additional resonance in an electrical response of the antenna, the distance selected to increase (i) an effective aperture of the antenna and (ii) a bandwidth of the antenna, in relation to the effective aperture and bandwidth without the additional resonance.

17. The antenna assembly of claim 16, wherein:

the PDEBG structure and the orientable radiating element are formed on printed circuit boards.

18. The antenna assembly of claim 16, further comprising:

a ground plane on an opposite side of the PDEBG structure from the orientable radiating element, the ground plane to contact a floor of the conductive cavity when the antenna assembly is installed therein.

19. The antenna assembly of claim 16, further comprising:

a feed coupled to the orientable radiating element through the PDEBG structure.

20. The antenna assembly of claim 16, wherein:

the orientable radiating element is a patch element.

21. The antenna assembly of claim 16, wherein:

the orientable radiating element is one of: a dipole element and a monopole element.

22. The antenna assembly of claim 16, wherein:

the antenna assembly is configured for insertion into a conductive cavity within an outer skin of a vehicle; and the antenna assembly has a height that allows the antenna assembly to be mounted in the conductive cavity substantially flush to the outer skin of the vehicle.

23. The antenna assembly of claim 16, wherein:

the orientable radiating element is a first orientable radiating element; and the antenna assembly further comprises a second orientable radiating element disposed above the PDEBG structure, the second orientable radiating element having a long dimension and a short dimension, the second orientable radiating element having an orientation that is orthogonal to an orientation of the first orientable radiating element, wherein the second orientable radiating element is on a different metal layer than the first orientable radiating element.

24. The antenna assembly of claim 16, wherein the distance is selected by adjusting at least one of a length and a width of the conductive cavity relative to the PDEBG structure.

25. A method for designing a rotationally polarized antenna having at least one orientable radiating element disposed above a polarization-dependent electromagnetic band gap (PDEBG) structure within a conductive cavity, the at least one orientable radiating element being oriented at a non-zero angle with respect to the PDEBG structure, the method comprising:

determining an approximate size of the conductive cavity;

selecting a dielectric material and a number and arrangement of unit cells to use in the PDEBG structure that will fit within the approximate size of the conductive cavity;

selecting an orientable radiating element;

selecting the non-zero angle such that the selected orientable radiating element supports one of: (i) substantially equal horizontal and vertical electric field magnitudes for use with circularly polarized waves, and (ii) different horizontal and vertical electric field magnitudes for use with non-circular elliptically polarized waves;

designing a unit cell of the PDEBG structure that will result in a 90 degree phase shift between total horizontal and vertical electric field components of the antenna, wherein designing a unit cell takes into consideration performance effects of the conductive cavity on the operation of the PDEBG structure; and adjusting a size of at least the conductive cavity to achieve an enhanced bandwidth for the rotationally polarized antenna, wherein a distance between side walls of the conductive cavity and one or more outermost edges of the PDEBG structure produces an additional resonance in an electrical response of the antenna, the distance selected to increase (i) an effective aperture of the antenna and (ii) a bandwidth of the antenna, in relation to the effective aperture and bandwidth without the additional resonance.

26. The method of claim 25, wherein:

designing a unit cell of the PDEBG structure includes using electromagnetic simulation software.

27. The method of claim 25, wherein:

designing a unit cell of the PDEBG structure includes modeling a capacitance between walls of the conductive cavity and edges of the PDEBG structure.

28. The method of claim 25, further comprising:

selecting a second orientable radiating element to be mounted above the PDEBG structure and the first orientable radiating element, the second orientable radiating element to be oriented in a direction that is orthogonal to an orientation direction of the first orientable radiating element.

29. The method of claim 25, wherein adjusting the size of at least the conductive cavity comprises adjusting at least one of a length and a width of the conductive cavity relative to the PDEBG structure.

* * * * *